US005566391A

United States Patent [19]

Williamson

[11] Patent Number: 5,566,391

[45] Date of Patent: Oct. 22, 1996

[54] PAINTING APRON WITH ONBOARD PAINT SUPPLY

[76] Inventor: Dorothy N. Williamson, 5124 NE. 14th Pl., Portland, Oreg. 97211

[21] Appl. No.: 497,473

[22] Filed: Jun. 30, 1995

[51] Int. Cl.[6] ..... A41B 13/10

[52] U.S. Cl. ..... 2/51; 2/48

[58] Field of Search ..... 2/51, 50, 48, 52, 2/94, 267, 268; 224/264, 257

[56] References Cited

U.S. PATENT DOCUMENTS

| | | | |
|---|---|---|---|
| 1,538,982 | 5/1925 | Glover | 2/51 |
| 1,675,072 | 6/1928 | Watermon | 2/48 |
| 1,979,879 | 11/1934 | Harris | 2/48 |
| 2,593,218 | 4/1952 | Swain . | |
| 2,697,465 | 12/1954 | Johnson . | |
| 2,945,614 | 7/1960 | Wittmann, Sr. | 2/51 |
| 3,115,638 | 12/1963 | Kikas | 2/48 |
| 3,535,709 | 10/1970 | Johannes | 2/51 |
| 4,637,075 | 1/1987 | Ingrisano et al. | 2/94 |
| 5,107,545 | 4/1992 | Potter . | |
| 5,370,286 | 12/1994 | Newman | 224/257 |

FOREIGN PATENT DOCUMENTS

| | | | |
|---|---|---|---|
| 540761 | 9/1955 | Belgium | 2/51 |

*Primary Examiner*—C. D. Crowder
*Assistant Examiner*—Gloria Hale
*Attorney, Agent, or Firm*—Kolisch, Hartwell, Dickinson, McCormack & Heuser

[57] ABSTRACT

A painting apron is provided for use in painting, such apron having a protective sheet of flexible, paint-impervious material to which a mounting arrangement is secured. The mounting arrangement includes an expandable loop which releasably receives a paint container including a cup portion and a removable lid portion which is tethered to such cup portion. The apron is secured to the wearer via a strap arrangement including one or more elongate straps which extend from the protective sheet.

14 Claims, 1 Drawing Sheet

PAINTING APRON WITH ONBOARD PAINT SUPPLY

TECHNICAL FIELD

The present invention relates generally to painting accessories, and more particularly, to a painting apron or smock which carries an onboard paint supply. Although the invention is described below for use in carrying paint, it will be understood that stain, varnish, lacquer and other finishing agents are included in the definition of paint as broadly used herein.

BACKGROUND ART

For many years now, painters have struggled with the process of moving their equipment as they progress from place to place during a paint job. This is especially troublesome in large jobs, where the painter must repeatedly advance a base station from which he or she operates. As the painter moves, it will be appreciated, so must he or she move the equipment which is being used (i.e., a paint bucket, paint brushes, scrapers, rags, etc.), requiring additional time and effort and increasing the probability of paint being accidentally spilled. Similarly, a painter may waste considerable time traveling to and from a paint supply in order to ensure that an even coast of paint is applied. These problems are especially prevalent amongst house painters, particularly where painting occurs from a ladder, and/or using a paint brush.

In the past, arrangements have been proposed whereby paint may be stored on a painter's person using an apron with an onboard paint reservoir. U.S. Pat. No. 2,945,614 to Wittmann, Sr., for example, shows a combination paint bucket and apron, the apron being formed with grommets to which hooks of a specially formed paint bucket may be secured to hold the bucket in place. U.S. Pat. No. 3,535,709 to Johannes similarly describes a painter's apron with an upwardly opening reservoir extending across the apron's lower edge. Neither of these aprons, however, provides sufficient protection from spilling of paint, and neither apron provides a complete system for carrying all of the tools and products which a painter must commonly utilize. What is need is an improved painting apron capable of carrying all that a painter requires in a simple, comfortable-to-use arrangement which avoids spilling of paint.

SUMMARY OF THE INVENTION

The aforementioned object is achieved by provision of a painting apron system having a protective sheet of flexible, paint-impervious material to which a mounting arrangement is secured. The mounting arrangement includes an expandable loop which releasably receives a paint container including a cup portion and a removable lid portion which is tethered to such cup portion. The apron is secured to the wearer via a strap arrangement including one or more elongate straps which extend from the protective sheet.

In one embodiment of the invention, the mounting arrangement includes a plurality of expandable loops aligned generally linearly across the protective sheet. At least one of such expandable loops is configured to releasably receive a paint container. Another is configured to releasably receive a paint brush and to hold the paint brush adjacent the protective sheet. Typically, the mounting arrangement includes a pair of resiliently expandable container-gripping loops and a pair of resiliently expandable brush-gripping loops positioned between the container-gripping loops. A scraper pocket and a rag holder similarly may be secured to the protective sheet, generally in alignment with the expandable loops.

These and other additional objects and advantages of the present invention will be more readily understood after consideration of the drawings and the detailed description of the preferred embodiment.

Figure 1:
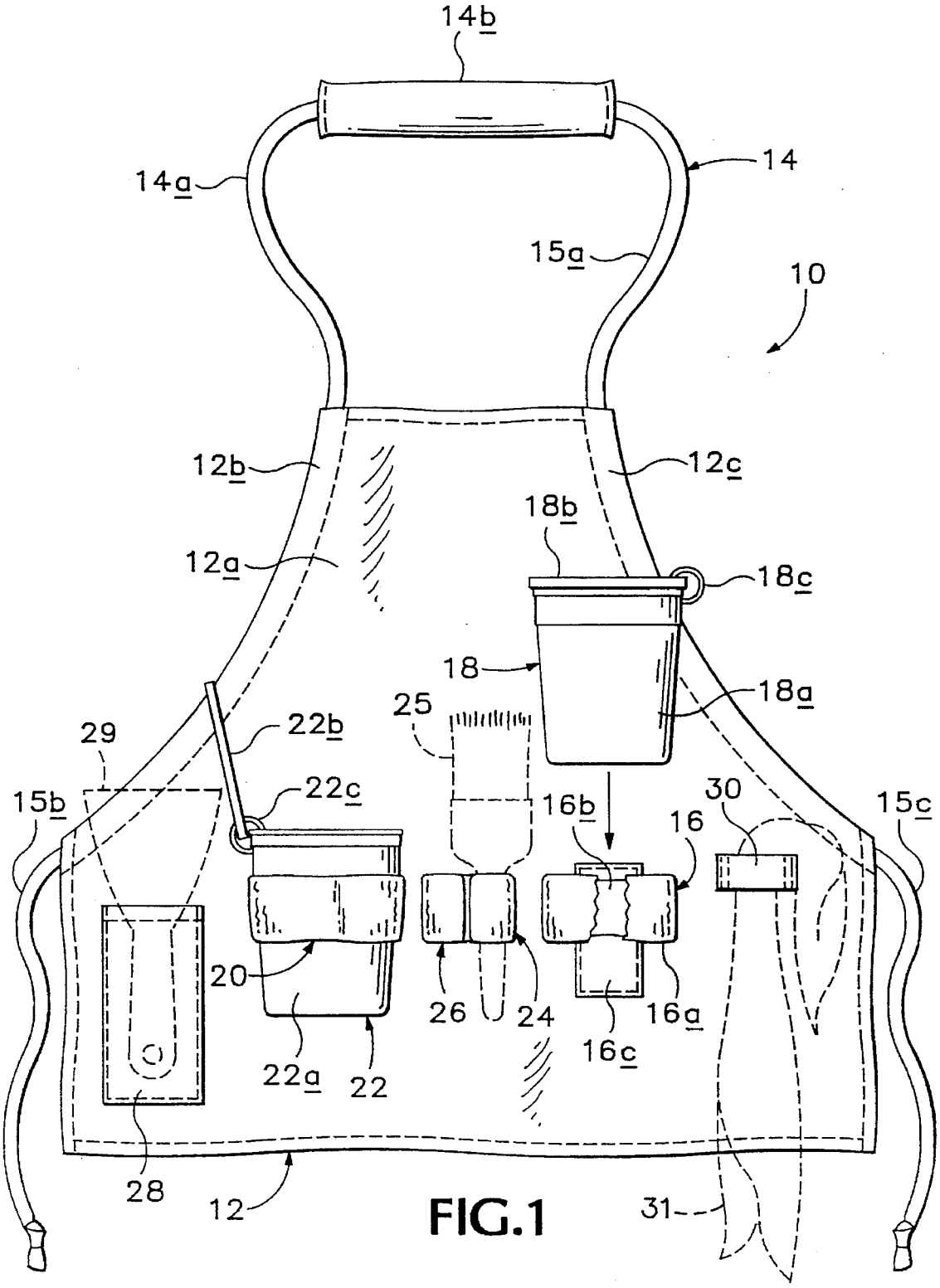
FIG. 1 is a front elevational view of a painting apron constructed in accordance with a preferred embodiment of the invention.

DETAILED DESCRIPTION OF THE PREFERRED EMBODIMENT AND BEST MODE OF CARRYING OUT THE INVENTION

Referring now to FIG. 1, a preferred embodiment of the invented painting apron system is shown generally at 10. In accordance with my teachings, apron system includes a protective sheet 12 which is specially configured to cover the torso of a wearer when the apron is in use. Sheet 12 is made of a flexible, paint-impervious material which may be wrapped around the wearer so as to provide protection for the wearer's clothes beneath. Typically, the protective sheet is made of canvas, but other materials may similarly be used.

In the depicted embodiment, sheet 12 is widest at its bottom, defining a pair of side edges which extend in parallel fashion to a position approximately ⅓ of the way from the apron's lower edge. The side edges of the apron then taper arcuately inwardly toward an upper edge to define arm recesses. This configuration provides for protection of the wearer's torso, but mobility of the wearer's arms.

As indicated, sheet 12 is provided with a strap arrangement 14, which includes an elongate cord **14*a* configured to define a neck strap 15*a* and a pair of waist straps 15*b*, 15*c*. The neck strap includes opposite end sections which are shown extending from opposite sides of the upper edge of the protective sheet. Cord 14*a* thus defines a flexible loop which wraps around the back of the wearer's neck to support the apron and its contents. The cord also typically includes a padded support segment 14*b*** which will rest against the wearer's neck to improve comfort of the apron.

In the depicted embodiment, cord **14*a* extends through apron sleeves 12*b*, 12*c* which are defined along the arcuate portions of the sheets opposite side edges. Opposite ends of the cord extend from the sleeves in the vicinity of the wearer's waist to provide a pair of flexible waist straps 15*b*, 15*c* which will wrap around the wearer's torso to secure the protective sheet to the wearer. Neck strap 15*a*** may be shortened simply by pulling one of the waist straps through the corresponding sleeve of the protective sheet. Similarly, the waist straps may be shortened by pulling a corresponding end section of the neck strap through one of the protective sheet's sleeves.

Although the strap arrangement described herein is a single strap arrangement, it will be understood that plural straps similarly could be employed without departing from the invention as described herein. The straps could, for example, be sewn directly to the protective sheet.

Referring now to the mounting arrangement, it will be understood that system 10 includes a plurality of expandable loops which are secured to an exterior body surface **12*a* of the protective sheet. The mounting arrangement accommodates carriage of various painting accessories on the wearer's person, including paint, brushes, a scraper and a rag. Loop 16, for example, may be seen to secure to body surface 12*a* so as to provide for capture of a paint container 18. Loop 20 similarly will be seen to secure to body surface 12*a* so as to provide for capture of a similar paint container 22. Loops 16 and 20 thus may be considered to serve as container-gripping loops which are adapted to hold two distinct paint supplies. Additional loops, such as those shown at 24 and 26, may be secured to body surface 12***a* to hold other painting accessories such as paint brush 25. Loops 24 and 26 thus may be considered to serve as brush-gripping loops. All loops are resiliently expandable to allow for tight capture of the containers and/or accessories.

Focusing now specially on loop 16, it will be noted that such loop is formed from a sleeve of gathered cloth 16*a*, which houses an elastic band 16*b*. When in use, the loop may be resiliently stretched so as to accommodate receipt of container 18 (indicated by the arrow in the drawing figure). A strip of relatively strong material such as leather shield 16*c* underlies the gripped container. Loop 16 thus will hold container 18 tightly against shield 16*c*. Container 22 is similarly held by loop 20. Because the loops are elastic, containers of differing size may be gripped. The loops similarly may be of different size.

Brush-receiving loops 24, 26 are shown between loop 20 and loop 16, all such loops being generally linearly aligned across the body surface of the protective sheet in the vicinity of the wearer's waist. A pocket 28 also may be defined on the protective sheet, such pocket generally being configured to hold a tool such as scraper 29. Scraper pocket 28, it will be noted, also is in linear alignment with the row of expandable loops. A non-expandable loop 30 similarly may be secured to the protective sheet generally in alignment with expandable loops 16, 20, 24, 26, such non-expandable loop being configured to hold a rag such as that shown at 31.

Focussing generally on the apron's paint container's, and specifically on container 18, it will be noted that such container includes a cup portion 18*a* which will carry a predetermined amount of paint, and a lid portion 18*b* which is configured to sealingly engage the cup portion so as to hold the paint within the cup portion. In the depicted embodiment, cup portion 18*a* is a one-quart plastic container with a corresponding lid portion 18*b* which is readily attachable and removable therefrom. A tether, or hinge, 18*c* attaches to both lid portion 18*b* and the cup portion 18*a* so as to link the lid portion to the cup portion at all times. When in use, the lid portion is flipped open and is held adjacent the cup portion so that it will not be lost. This is illustrated more directly by paint container 22 which similarly includes a cup portion 22*a* and a lid portion 22*b* which is associated with the cup portion via a tether 22*c*.

Although a preferred embodiment of the present invention has been shown and described, it will be appreciated by those skilled in the art that changes and form and detail may be made without departing from the spirit and scope of the invention as defined by the appended claims.

I claim:

1. A painting apron system comprising:

a protective sheet of flexible, paint-impervious material, said protective sheet including a body surface configured to substantially cover a torso of a wearer;

a strap arrangement including one or more elongate straps which extend from said protective sheet to secure said protective sheet to the wearer;

a detachable container including a cup portion and a removable lid portion tethered to said cup portion; and a mounting arrangement including an expandable loop secured to said body surface of said protective sheet, and configured to releasably receive said container and to hold said container adjacent said protective sheet.

2. The painting apron system of claim 1, wherein said mounting arrangement includes a plurality of waist-level expandable loops aligned generally linearly across said protective sheet.

3. The painting apron system of claim 2, wherein at least one of said expandable loops is configured to releasably receive a brush and to hold the brush adjacent said protective sheet.

4. The painting apron system of claim 3, wherein said mounting arrangement includes a pair of expandable container-gripping loops and a pair of expandable brush-gripping loops, said brush-gripping loops being positioned between said container-gripping loops.

5. The painting apron system of claim 4, wherein said loops are resiliently elastic.

6. The painting apron system of claim 4 which further comprises a scraper pocket secured to said protective sheet in linear alignment with said expandable loops.

7. The painting apron system of claim 6 which further comprises a rag holder defined by a waist-level non-expandable loop which is secured to said protective sheet.

8. The painting apron system of claim 7, wherein said strap arrangement includes one or more elongate waist straps which extend from said protective sheet to wrap around the torso of the wearer to secure said protective sheet to the wearer.

9. The painting apron system of claim 8, wherein said strap arrangement further includes an elongate neck strap having opposite ends which extend from said protective sheet, said neck strap including a padded support segment configured to rest against a neck of the wearer.

10. A painting apron system for use in holding painting fluids and associated painting tools, said painting apron system comprising:

a protective sheet of flexible, paint-impervious material, said protective sheet including a body surface configured to substantially cover a torso of a wearer;

one or more elongate waist straps which extend from said protective sheet to wrap around the torso of the wearer to secure said protective sheet to the wearer;

an elongate neck strap having opposite ends which extend from said protective sheet, said neck strap including a padded support segment configured to rest against a neck of the wearer;

one or more detachable containers configured to carry selected painting fluids, each container including a cup portion and a removable lid portion, each of said lid portions being tethered to a corresponding cup portion; and a mounting arrangement including a plurality of elongate elastic bands secured to said body surface to define a waist-level generally horizontal row across said protective sheet, said elastic bands defining a plurality of resiliently expandable loops adapted to releasably receive said containers and painting tools, and to hold said containers and painting tools adjacent said protective sheet in generally horizontal alignment across the torso of the wearer.

11. The painting apron system of claim 10, wherein said mounting arrangement includes a pair of expandable container-gripping loops and a pair of expandable brush-gripping loops, said brush-gripping loops being positioned between said container-gripping loops.

12. The painting apron system of claim 11 which further comprises a scraper pocket secured to said protective sheet in linear alignment with said expandable loops.

13. The painting apron system of claim 12 which further comprises a rag holder defined by a non-expandable loop which is secured to said protective sheet.

14. The painting apron system of claim 10, wherein said paint container is made of plastic.

* * * * *